US011502465B2

(12) United States Patent
Zebhauser et al.

(10) Patent No.: US 11,502,465 B2
(45) Date of Patent: Nov. 15, 2022

(54) ELECTRICAL DISTRIBUTOR DEVICE, SIGNAL TRANSMISSION SYSTEM AND METHOD OF MAKING AN ELECTRICAL DISTRIBUTOR DEVICE

(71) Applicant: Rosenberger Hochfrequenztechnik GmbH & Co. KG, Fridolfing (DE)

(72) Inventors: Martin Zebhauser, Laufen (DE); Till Bredbeck, Traunstein (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 17/273,429

(22) PCT Filed: Aug. 30, 2019

(86) PCT No.: PCT/EP2019/073242

§ 371 (c)(1),
(2) Date: Mar. 4, 2021

(87) PCT Pub. No.: WO2020/048890

PCT Pub. Date: Mar. 12, 2020

(65) Prior Publication Data

US 2022/0037845 A1 Feb. 3, 2022

(30) Foreign Application Priority Data

Sep. 4, 2018 (DE) ..... 10 2018 121 582.7

(51) Int. Cl.
*H01R 11/00* (2006.01)
*H01R 31/06* (2006.01)
(Continued)

(52) U.S. Cl.
CPC ..... *H01R 31/06* (2013.01); *H01R 13/6589* (2013.01); *H01R 24/86* (2013.01);
(Continued)

(58) Field of Classification Search
CPC ..... H01R 13/6585; H01R 13/6589; H01R 31/06; H01R 24/86; H01R 43/20; H01B 11/08; H01B 11/1033
See application file for complete search history.

(56) References Cited

U.S. PATENT DOCUMENTS 5,971,799 A * 10/1999 Swade ..... H01R 27/02 439/502
6,036,533 A * 3/2000 Huang ..... H01R 31/02 439/502

(Continued)

FOREIGN PATENT DOCUMENTS

CN 206 116 830 U 4/2017
DE 94 11 851 U1 12/1994

(Continued)

OTHER PUBLICATIONS

Thornwood, Twinaxial Auto-Termination Cable Assembly , IBM Technical Disclosure Bulletin, International Business Machines Corp., US, vol. 32, No. 10A, Mar. 1, 1990 (Mar. 1, 1990), pp. 71-73, XP000083166, ISSN: 0018-8689.

*Primary Examiner* — Thanh Tam T Le
(74) *Attorney, Agent, or Firm* — Donald S. Showalter, Esq.; GrayRobinson, P.A.

(57) ABSTRACT

Embodiments of a high-frequency electrical distributor device may have an input end with a connector of a first connector type, and an output end with at least two connectors of at least one second connector type which is different from the first connector type. Embodiments may further include a distributor region between the connector at the input end and the connector at the output end. The connector at the input end has at least two differential contact element pairs. The distributor region distributes the contact element pairs of the connector at the input end to the connectors at the output end.

19 Claims, 4 Drawing Sheets

(51) Int. Cl.

| | |
|---|---|
| ***H01R 13/6589*** | (2011.01) |
| ***H01R 24/86*** | (2011.01) |
| ***H01R 43/20*** | (2006.01) |
| *H01B 11/08* | (2006.01) |
| *H01B 11/10* | (2006.01) |

(52) U.S. Cl.
CPC ..... *H01R 43/20* (2013.01); *H01B 11/08* (2013.01); *H01B 11/1033* (2013.01)

(56) References Cited

U.S. PATENT DOCUMENTS 6,106,328 A * 8/2000 O'Neal ..... H01R 27/02 439/503
6,250,936 B1 * 6/2001 Armistead ..... H01R 13/65915 439/98
6,486,407 B1 * 11/2002 Hawker ..... H01R 31/02 174/72 R
6,623,295 B2 * 9/2003 DeLadurantaye, III ..... H01R 24/40 439/502
6,746,273 B1 * 6/2004 Liu ..... H04L 12/10 439/502
6,767,255 B1 * 7/2004 Croswell ..... H01R 31/02 439/651
6,786,764 B2 * 9/2004 Sivertsen ..... H01R 31/065 439/502
6,907,615 B1 * 6/2005 Alexander ..... H04N 21/4131 439/502
6,913,482 B1 * 7/2005 Wu ..... H01R 25/003 439/502
6,955,564 B2 10/2005 Cho et al.
6,997,753 B2 * 2/2006 Broomall ..... H01R 24/547 439/638
7,013,008 B1 * 3/2006 Rachlin ..... H04M 1/738 379/438
7,057,108 B1 * 6/2006 Sodemann ..... H01R 13/7135 439/639
7,270,568 B2 * 9/2007 Osypka ..... H01R 11/00 439/502
7,488,187 B2 * 2/2009 Wolf ..... H01R 31/06 439/502
7,591,673 B2 * 9/2009 Chan ..... G06F 1/266 439/502
7,633,560 B1 * 12/2009 Sivertsen ..... H04N 5/268 348/705
8,004,115 B2 * 8/2011 Chapel ..... H01R 25/003 307/64
8,010,811 B2 * 8/2011 Leininger ..... H01R 25/003 439/1
8,517,772 B2 * 8/2013 Wu ..... H01R 24/62 439/501
8,608,505 B2 * 12/2013 Mantay ..... H01R 31/02 439/505
8,692,113 B2 * 4/2014 Huang ..... H01R 11/12 439/98
8,694,080 B2 * 4/2014 Farrior ..... A61B 5/303 600/509
10,033,143 B1 * 7/2018 Giordano ..... H01R 31/06
10,233,676 B2 * 3/2019 Lin ..... E05B 73/0005
10,404,004 B2 * 9/2019 Fuda ..... H01R 13/44
10,817,453 B2 * 10/2020 Abdul-Razzak ..... G06F 1/1632
2005/0090152 A1 4/2005 Broomall et al.

FOREIGN PATENT DOCUMENTS

| | | | |
|---|---|---|---|
| DE | 103 54 950 | A1 | 6/2004 |
| DE | 20 2006 019 107 | U1 | 3/2007 |
| DE | 11 2013 005 463 | T5 | 8/2015 |
| DE | 10 2015 109 311 | A1 | 12/2016 |
| EP | 2953140 | A1 | 9/2015 |
| JP | 2012 84275 | A | 4/2012 |
| WO | 2014018533 | A2 | 1/2014 |

* cited by examiner

ELECTRICAL DISTRIBUTOR DEVICE, SIGNAL TRANSMISSION SYSTEM AND METHOD OF MAKING AN ELECTRICAL DISTRIBUTOR DEVICE

CROSS REFERENCE TO RELATED APPLICATIONS

This is a U.S. National Phase Entry under 35 U.S.C. § 371 of International Application No. PCT/EP2019/073242 filed Aug. 30, 2019 entitled: ELECTRICAL DISTRIBUTOR DEVICE, METHOD FOR INSTALLATION AND SIGNAL TRANSMISSION SYSTEM which designates the United States and at least one other country in addition to the United States and claims priority to German Patent Application No. 10 2018 121 582.7 filed Sep. 4, 2018.

STATEMENT REGARDING FEDERALLY-SPONSORED RESEARCH OR DEVELOPMENT

Not applicable.

INCORPORATION BY REFERENCE

International Application No. PCT/EP2019/073242 and German Patent Application No. 10 2018 121 582.7 are each expressly incorporated herein by reference in their entireties to form part of the present disclosure.

FIELD OF THE INVENTION

The invention relates to the field of high-frequency electrical distributor devices, more particularly, one aspect of the present invention relates to a high-frequency electrical distribution device having an input-side connector, at least two output-side connectors and an adapter means arranged between the input-side connector and the output-side connectors.

A further aspect of the invention relates to a method for manufacturing a high-frequency electrical distributor device.

Yet a further aspect of the invention relates to a high-frequency signal transmission system for high-frequency technology, comprising an electrical distributor device.

BACKGROUND

A large number of electrical connectors of various types are known from electrical engineering. As is known, electrical connectors are used to transmit electrical energy and/or electrical signals with the greatest possible bandwidth.

Electrical connectors are subject to particularly stringent requirements, in particular in high-frequency technology. Electrical connectors for the transmission of high-bit-rate data signals are used, inter alia, in the automotive industry, or in vehicles.

Sometimes, for example in the case of autonomous operation of a vehicle, or if assistance systems are used, large amounts of data from a plurality of cameras, various sensors and navigation sources have to be combined and transferred, usually in real time. The operation of many devices, screens and cameras therefore requires a powerful infrastructure in the vehicle electronics. For this reason, the requirements for plug-in connections and cable connections within a vehicle are now very stringent with regard to the necessary data rates. At the same time, in order to save installation space and weight, it is important to make the connectors and the underlying circuit technology as compact as possible.

In most cases, cables assembled with connectors transmit electrical signals (data and/or electrical supply) between different electrical assemblies, in particular printed circuit boards (PCBs). If a change between interfaces, or connector types, for example between an HSD standard and an H-MTD standard, is required for a specific application, it may sometimes be necessary to change the electrical assemblies, which may lead to a complete reconfiguration of electrical circuits, or even a redesign of motherboards or processors. This may be problematic, for example, with regard to installation space specifications and complex approval procedures. An interface change, or a change between different connector types, as well as a signal distribution should thus preferably be performed irrespective of the existing electrical assemblies. In the case of signal transmission in high-frequency technology, it is also important to observe the particularly stringent requirements for high signal quality in high-frequency technology.

BRIEF SUMMARY OF THE INVENTION

The present invention is based on the object of providing an electrical distributor device for high-frequency technology, which in particular allows high-bit-rate and preferably modular signal distribution.

The present invention is also based on the object of providing an assembly method for manufacturing an electrical distributor device for high-frequency technology, which in particular allows flexible and modular manufacture of the distributor device.

The invention is further based on the object of providing an advantageous signal transmission system for high-frequency technology.

Provided according to the invention is an electrical distributor device for high-frequency technology, having an input-side connector according to a first connector type, at least two output-side connectors according to at least one second connector type that is different from the first connector type, and a distributor region arranged between the input-side connector and the output-side connectors.

A "connector type" in the context of the invention means a particular connector standard (e.g. HSD or H-MTD) as opposed to a specific embodiment variant of such a standard (e.g. as a plug or as a socket).

The invention is not limited to use with specific connector types, and in particular the invention is suitable for connector types for high-frequency technology. Inter alia, the connector types PL, BNC, TNC, SMBA(Fakra), SMA, SMB, SMS, SMC, SMP, BMS, HFM, HSD, H-MTD, BMK, Mini-Coax or Makax may be provided in any combination.

Possible embodiment variants of the input-side connector and/or the output-side connectors may be, for example, a plug, an integrated connector, a socket, a coupler or an adapter. For example, the input-side connector and the output-side connectors may all together be realized as a plug, or all together realized a coupler. However, the input-side connector and the output-side connectors may also realize different embodiments of the corresponding connector type, or connector standard.

It is to be noted that the terms "input side" and "output side" are not intended in this case to indicate the direction of signal transmission, which may in principle be in any direction, and also bidirectional, between the input side connector and the output side connectors. The chosen terms merely serve to designate the connectors in an easily distinguishable manner.

The connectors according to the invention are preferably designed, or configured, for high-bit-rate signal transmission.

Preferably, the output-side connectors are realized identically according to the second connector type. In the context of the distributor device according to the invention, a first connector type and a second connector type (and preferably no further connector types) are provided in this case. In particular, if exactly two output-side connectors are provided, identical realization of the output-side connectors according to the second connector type may be advantageous.

It is also possible, however, for the output-side connectors to be realized differently. In the context of the distributor device according to the invention, at least one first connector type, one second connector type and a third connector type are then provided, in which case one of the output-side connectors is realized according to the second connector type and the other output-side connector is realized according to the third connector type. If more than two output-side connectors are provided, the number of connector types used may also be increased accordingly.

For simplicity, the invention is described below substantially on the basis of the use of two output-side connectors, both of which are realized in accordance with a connector standard. However, this is not to be understood as restrictive.

According to the invention, the input-side connector is multipolar and has at least two differential contact element pairs.

The input-side connector is thus designed for the transmission of differential signals, with two contact elements, which together form a differential contact element pair, being provided for the transmission of each differential signal.

The use of differential signal transmission is generally particularly suitable for the transmission of high-frequency signals, since potential transmission interference can advantageously be cancelled out due to the formation of the difference when the useful signal is obtained.

According to the invention, it is further provided that the distributor region is designed to divide the contact element pairs of the input-side connector between the output-side connectors, such that each of the output-side connectors has at least one differential contact element pair.

The output-side connectors are thus also designed for differential signal transmission.

Within the scope of the said "dividing", according to the invention the contact elements forming a contact element pair are not separated, but assigned to a common output-side connector.

Since the differential contact element pairs are divided between the output-side connectors by the distributor region according to the invention, dividing of signals for high-frequency technology can be effected in an advantageous manner and without the need to adapt further electrical assemblies, for example electrical circuits on printed circuit boards and/or on microchips, with the result that intervention in the underlying signal transmission system is kept low. According to the invention, there is no need for reconfiguration of the assemblies and circuit boards involved.

It may be provided that the input-side connector and/or at least one of the output-side connectors transmit/transmits further signals, including non-differential signals, and that further contact elements are provided for this purpose. For example, it may be provided that, in addition to data transmission, electrical supply signals are also distributed by the electrical distributor device between the input-side connector and the output-side connectors, in addition to the dividing of the differential contact element pairs according to the invention.

It may be provided in a development of the invention that the distributor region is designed to electrically connect an outer conductor part of the input-side connector to outer conductor parts of the output-side connectors.

This makes it possible to provide suitable shielding of the distributor device and, if necessary, to distribute a common ground reference between the connectors.

An outer conductor part of a connector may, in particular, be a metallic housing part that encloses components of the connector, in particular the differential contact element pairs, and is usually crimped, or pressed, with a cable sheath of a cable leading into the connector and/or with a support sleeve applied to an outer conductor of the cable. The outer conductor part may also be part of an interface of the input-side or output-side connector, and thus be of a design characteristic of the respective connector type.

In a development of the invention, in particular two output-side connectors may be provided, between which the distributor region divides the contact element pairs.

Thus, in particular, an electrical distributor device in the manner of a Y-distributor can be provided. Such a distributor device is advantageous for many applications.

In principle, however, more than two output-side connectors may also be provided, for example three output-side connectors, four output-side connectors or even more output-side connectors, between which the distributor region divides the contact element pairs. Accordingly, the number of differential contact element pairs of the input-side connector to be divided may increase.

Preferably, the input-side connector has two differential contact element pairs that are distributed to two output-side connectors, with one of the contact element pairs being assigned to each of the output-side connectors.

In principle, however, there may be any number of differential contact element pairs to be divided. For example, it may be provided that the input-side connector has three differential contact element pairs, four differential contact element pairs, five differential contact element pairs, six differential contact element pairs, or even more differential contact element pairs, are distributed to output-side connectors. To the extent that more than two differential contact element pairs to be divided are provided, for example three contact element pairs, provision may also be made to distribute them to a smaller number of output-side connectors. For example, provision may be made for three differential contact element pairs to be divided between two output-side connectors, with two differential contact element pairs being assigned to one of the output-side connectors and only one differential contact element pair being assigned to the second output-side connector. The specific distribution of a plurality of differential contact element pairs to output-side connectors may be determined by a person skilled in the art according to the specific application.

It may be provided in a development of the invention that the contact element pairs of the input-side connector are arranged in a mutually crossed or parallel arrangement.

In a top view of the end face of the input connector intended for contacting, in the case of a parallel arrangement contact elements forming a contact element pair may be arranged directly adjacent to each other, i.e. above or below each other; in the case of a crossed arrangement, by contrast, the contact element pairs are distributed diagonally, or cross each other.

The electrical distributor device may be provided for signal transmission in a signal transmission system in which signal transmission is provided by means of twisted wire pairs, or so-called twisted-pair cables. Alternatively, the use of parallel-pair cables, or a corresponding type of signal transmission, may be provided.

It may additionally be provided in a development that the input-side connector and/or the distributor region have/has at least one shielding plate for electromagnetically shielding the differential contact element pairs from each other.

Shielding of the contact element pairs from each other is advantageous for the transmission of high-frequency signals in order to prevent over-coupling or crosstalk between the high-frequency signals. The use of a shielding plate may be particularly suitable in the case of a parallel arrangement of the contact element pairs.

The use of the shielding plate may be particularly advantageous, in particular, in the transmission of signals at a transmission rate of greater than one Gigabit per second (1 GBit/s).

As mentioned above, there may be any number of differential contact element pairs of the input-side connector to be divided, and any number of output-side connectors to which the contact element pairs are distributed. For this reason, it may also be provided that a plurality of contact element pairs are distributed to at least one of the output-side connectors. In this case, it may be advantageous to provide a shielding plate also in the output-side connector having the plurality of contact element pairs, in order to provide shielding of the multiple contact element pairs by the shielding plate.

The shielding plate may preferably be electrically connected to the outer conductor part of the input-side and/or output-side connector. Preferably, the shielding plate contacts the outer conductor part of the input-side and/or output-side connector directly and, if necessary, in a redundant manner.

The shielding plate may be realized in the input-side connector and extend into the distributor region. However, the shielding plate may also be realized in the distributor region and extend into the input-side connector. The use of two shielding plates, arranged respectively in the input-side connector and in the distributor region, may also be provided.

It may be provided that the input-side connector has an insulating part for receiving the individual contact elements. The insulating part may additionally be designed to receive the shielding plate. Accordingly, the output-side connectors may also have an insulating part.

It may additionally be provided in an embodiment of the invention that the distributor region has a metallic housing portion, which is realized integrally with the outer conductor part of the input-side connector and/or which is electrically connected to the outer conductor part of the input-side connector.

The distributor region may thus preferably be enclosed by the metallic housing portion, in particular in a region in which no further means for shielding the signal transmission are present. Preferably, the outer conductor part of the input-side connector projects at least partially over the distributor region and thus realizes the metallic housing portion. Particularly good shielding of the electrical distributor device can thereby be provided.

It may be provided in a development that the distributor region has at least one electrical cable, which is fixed in the metallic housing portion and which extends to an assigned output-side connector.

The electrical distributor device can thus be used in a particularly flexible manner. In this variant, the electrical distributor device may, for example, realize a Y-cable (in the case of two output-side connectors) up to a cable harness or a breakout cable (if more than two output-side connectors are used).

Additionally or alternatively, it may also be provided in a development that at least one of the output-side connectors is attached directly to the metallic housing portion of the distributor region.

The electrical distributor device may therefore also be realized without the use of electrical cables and constitute, for example, an adapter.

It may also be provided, however, that one of the output-side connectors is directly connected to the metallic housing portion of the distributor region and another output-side connector is coupled via an electric cable.

It may also be provided in a development of the invention that the distributor region is designed to connect, preferably to crimp, the contact element pairs of the input-side connector to inner conductors of a respectively assigned electrical cable, or to inner conductor parts of a respectively assigned output-side connector.

Crimping of the contact element pairs enables a strain relief to be provided at the same time.

In a development of the invention, a support sleeve may further be provided in the distributor region for each electrical cable, in order to electrically and mechanically contact an outer conductor of the respective electrical cable.

The support sleeve may advantageously be used to improve the mechanical holding force, and thus the electrical contacting, of the outer conductor of the respective electrical cable, in particular when the outer conductor part of the connector and/or the metallic housing portion of the distributor region is subsequently crimped onto the support sleeve.

Depending on the cross-section of the electric cable, the support sleeve may be round or oval, for example. Preferably, an oval support sleeve is provided.

The support sleeve may be crimped onto a cable shield, in particular a braided cable shield, that has been exposed by previous removal of the cable sheath, after which the braided cable shield can be folded back over the support sleeve. This makes it possible, inter alia, also to effect electrical contacting of the outer conductors of the cables to the outer conductor part of the input-side connector, of the output-side connector and/or to the metallic housing portion of the distributor region may take place—in particular if the outer conductor part and/or the metallic housing portion are in turn crimped with the support sleeve. However, it is not absolutely necessary for the braided cable shield to be folded back over via the support sleeve for contacting of the braided cable shield, for example by the outer conductor part of the input-side connector, since contacting may also be effected indirectly by contacting of the support sleeve, which is crimped onto the cable shielding braid. In the case of the folded-over braided cable shield, however, the electrical contact can be improved.

If necessary, a common support sleeve may also be provided for all electrical cables.

It may in particular be provided in a development of the invention that the input-side connector has an HSD interface.

The input-side connector may thus be realized as an HSD connector, or the connector of the input-side connector may be of the HSD connector type.

An HSD ("High-Speed Data") connector, or a so-called Rosenberger HSD connector, is particularly suitable for high-bit-rate data transmission for use in high-frequency technology. An HSD connector is an impedance-controlled connector, in particular for transmitting differential digital signals of low voltage.

It may in particular also be provided in a development of the invention that at least one of the output-side connectors has an H-MTD interface, preferably a two-pole H-MTD interface, for accommodation in a modular connector.

The output-side connector may thus be realized as an H-MTD connector, or as a so-called Rosenberger H-MTD connector, or the connector of the output-side connector may be of the H-MTD connector type.

A Rosenberger H-MTD ("High-Speed Modular Twisted-Pair Data") connector is known to be a particularly robust connector that can provide the transmission of high-bit-rate signals, in particular for the automotive sector, with, at the same time, a high degree modularity of the overall system.

The H-MTD interface may be, in particular, a two-pole connector that carries a differential signal and that is designed to be plugged and fixed into a modular system housing, for example together with other connectors.

It is particularly preferable if the input-side connector is realized as an HSD connector and the two output-side connectors are realized as H-MTD connectors.

The invention also relates to an assembly method for manufacturing an electrical distributor device for high-frequency technology, according to which an input-side connector is realized according to a first connector type having at least two differential contact element pairs, and wherein at least two output-side connectors are realized according to at least one second connector type that is different from the first connector type, and wherein contact elements of the output-side connectors are connected to contact elements of the input-side connector via a distributor region in such a manner that the contact element pairs of the input-side connector are divided between the output-side connectors, such that each of the output-side connectors has at least one differential contact element pair.

It may be provided in a further development that the output-side connectors are connected to the common input-side connector via respective electrical cables.

As a preparatory measure within the assembly method, it may be provided that the electrical cables are first freed from a cable sheath at their ends.

Finally, in a further development it may be provided that a support sleeve is crimped onto an outer conductor, preferably a braided cable shield, of a respective cable in the distributor region.

It may further be provided that the individual inner conductors of the cables are stripped, at least in a front region of a first end of the respective cable, and are electrically connected, preferably crimped or soldered, to the contact elements of the input-side connector. The contact elements may then optionally be inserted into a common insulating part of the input-side connector.

Furthermore, at least in the region of the input-side connector, an outer conductor part may be fitted, which extends at least between the contact elements and the support sleeves in the axial direction (along a longitudinal axis of the input-side connector) and electrically contacts respective outer conductors of the cables.

Finally, it may also be provided that the second ends of the electrical cables are assembled with a respective output-side connector.

As part of the fitting of the support sleeve onto the respective cable, it may preferably be provided that the braided cable shield is subsequently folded back onto the support sleeve. Folding back of the braided cable shield can aid the strain relief of the cables, and can also be advantageous for the electrical contacting of the outer conductor part of the input-side connector to the respective outer conductors of the cables. However, electrical contacting of the outer conductors of the cables to the outer conductor part of the input-side connector may also be effected indirectly, via the support sleeves.

It may further be provided that, in the region between the support sleeve and the region in which the individual inner conductors of the cables are stripped, a foil shield of the respective cable, which is located beneath the braided cable shield, remains at least in one portion.

Following the fitting of the outer conductor part on the input-side connector, it may further be provided that a plastic housing is pushed onto the outer conductor part of the first connector and fixed, if necessary by use of a so-called secondary securing means.

In a further development, it may be provided that at least one shielding plate is used in order to electromagnetically shield the differential contact element pairs of the input-side connector from each other. Preferably, the shielding plate may be inserted into the insulating part.

It may also be provided to shield a plurality of contact element pairs of one of the output-side connectors from each other by means of a shielding plate.

The invention also relates to a signal transmission system for high-frequency technology, comprising an electrical distributor device, a first electrical assembly, a second electrical assembly and at least one third electrical assembly, wherein at least two electrical signals are divided, via the electrical distributor device, from the first electrical assembly between the second electrical assembly and at least the third electrical assembly. The electrical distributor device has an input-side connector according to a first connector standard connected to the first assembly, at least one output-side connector according to a second connector standard connected to the second assembly, and at least one further output-side connector according to a second standard connected to the third assembly. The input-side connector is designed for differential transmission of the electrical signals, and for this purpose has at least two differential contact element pairs, which are divided between the output-side connectors by means of a distributor region arranged between the input-side connector and the output-side connectors, such that each of the output-side connectors has at least one differential contact element pair.

The electrical assemblies preferably generate and/or process the differential signals, which are divided by means of the distributor device and transmitted to the other assemblies. Preferably, the assemblies generate and/or process high-bit-rate, digital data signals.

In a preferred embodiment, the electrical distributor device is a Y-distributor, on the first side of which a standard HSD interface, preferably four-pole, is arranged in a crossed or parallel arrangement of two contact element pairs, and on the second side of which there extend two separate shielded parallel-pair cables with a jointly connected outer conductor, on the respective end of each of which, for example, an H-MTD interface is attached.

Finally, the invention also relates to the use of an electrical distributor device as described above in a vehicle, in particular a motor vehicle, for transmitting and dividing high-bit-rate signals between connectors of different designs.

Possible fields of application may include autonomous driving, driver assistance systems, navigation systems, "infotainment" systems, front entertainment systems, Internet connections and wireless gigabit (IEEE 802.11ad standard). Potential applications include, inter alia, high-resolution cameras, for example 4K and 8K cameras, sensor technology, on-board computers, high-resolution screens, high-resolution dashboards, 3D navigation devices and mobile communications devices.

In principle, the electrical distributor device is, of course, suitable for any application within the entire field of electrical engineering, in particular high-frequency technology.

Features that have already been described in connection with the distributor device according to the invention can, of course, also be advantageously implemented for the assembly method according to the invention, the signal transmission system and the use described—and vice versa. Moreover, advantages already mentioned in connection with the distributor device according to the invention may also be understood in relation to the assembly method according to the invention, the signal transmission system, or the use described—and vice versa.

In addition, it should be noted that terms such as "comprising", "having" or "with" do not exclude other features or steps. Moreover, terms such as "a" or "the" that indicate a single number of steps or features do not exclude a plurality of features or steps—and vice versa.

Exemplary embodiments of the invention are described in greater detail in the following, on the basis of the drawing.

The figures each show preferred exemplary embodiments in which individual features of the present invention are represented in combination with each other. Features of an exemplary embodiment can also be implemented separately from the other features of the same exemplary embodiment, and can therefore be easily combined, by a person skilled in the art, with features of other exemplary embodiments to form further useful combinations and sub-combinations.

BRIEF DESCRIPTION OF THE DRAWINGS

In the figures of the drawings, elements that are functionally identical are denoted by the same reference labels.

In the drawings, which are shown in schematic form.

DETAILED DESCRIPTION OF PREFERRED EMBODIMENTS

Figure 1:
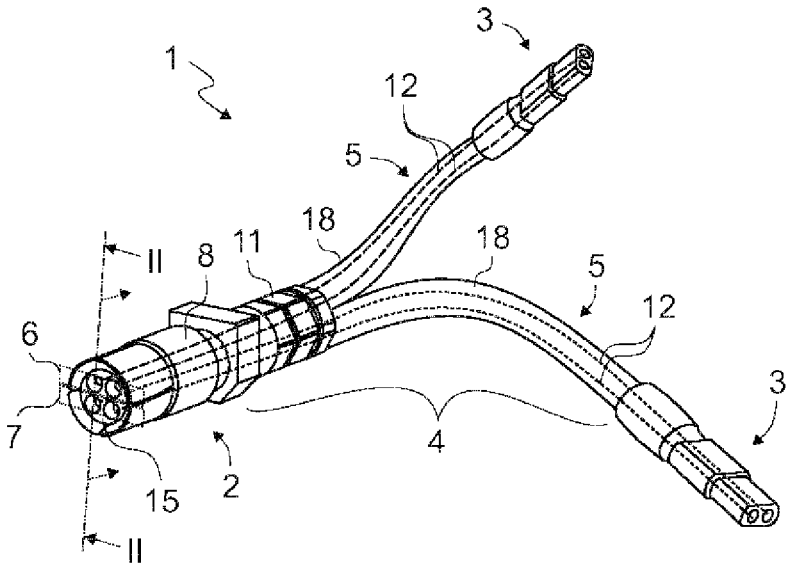
FIG. 1 is a perspective view of an embodiment of an electrical distribution device having an input-side connector, a distributor region and two output-side connectors.

FIG. 1 shows a perspective view of an electrical distributor device 1 for high-frequency technology. The electrical distributor device 1 has an input-side connector 2 according to a first connector type, two output-side connectors 3 according to a second connector type that is different from the first connector type, and a distributor region 4 arranged between the input-side connector 2 and the output-side connectors 3. In principle, the output-side connectors 2 may also be realized differently, for example according to a second connector type and a third connector type.

Even if, in the exemplary embodiment, only two output-side connectors 3 are provided, in principle any number of output-side connectors 3 may be provided, for example also three, four, five, six or even more output-side connectors 3.

The specific connector types used are also not important according to the invention. Purely by way of example, in the exemplary embodiments the input-side connector 2 is realized as an HSD connector, or has an HSD interface. Likewise by way of example, the output-side connectors 3 have an H-MTD interface, in this case a two-pole H-MTD interface for accommodation in a modular connector (not represented).

In the exemplary embodiments, the distributor region 4 has electrical cables 5, to each of which an output-side connector 3 is connected. However, the electrical cables 5 may also be omitted.

It is provided that the input-side connector 2 is multipolar and has at least two differential contact element pairs 6, 7 (cf. in particular FIGS. 1, 2, 3 and 11). In the exemplary embodiment, a first contact element pair 6 and a second contact element pair 7 are provided. In principle, however, any number of differential contact element pairs may be provided, for example three, four, five, six or even more differential contact element pairs.

The distributor region 4 is designed to divide the contact element pairs 6, 7 of the input-side connector 2 between the output-side connectors 3.

The contact element pairs 6, 7 of the input-side connector 2 may be arranged in a mutually crossed or parallel arrangement. In the exemplary embodiment, a parallel arrangement is shown, but this is not restrictive of the present invention. The distribution of the contact element pairs 6, 7 to the output-side connectors 3 is indicated in FIG. 1 by a dashed signal guide (inter alia, by the inner conductors 12 of the cables 5).

The input-side connector 2 has an outer conductor part 8, which in a shielding manner surrounds the other internal components of the input connector 2. The outer conductor part 8 may already be part of the interface of the input-side connector 2. In principle, it may be envisaged that a plastic housing (not represented in the figures) is pushed onto the outer conductor part 8 and completes, or supplements, the provided interface of the input-side connector 2.

Figure 2:
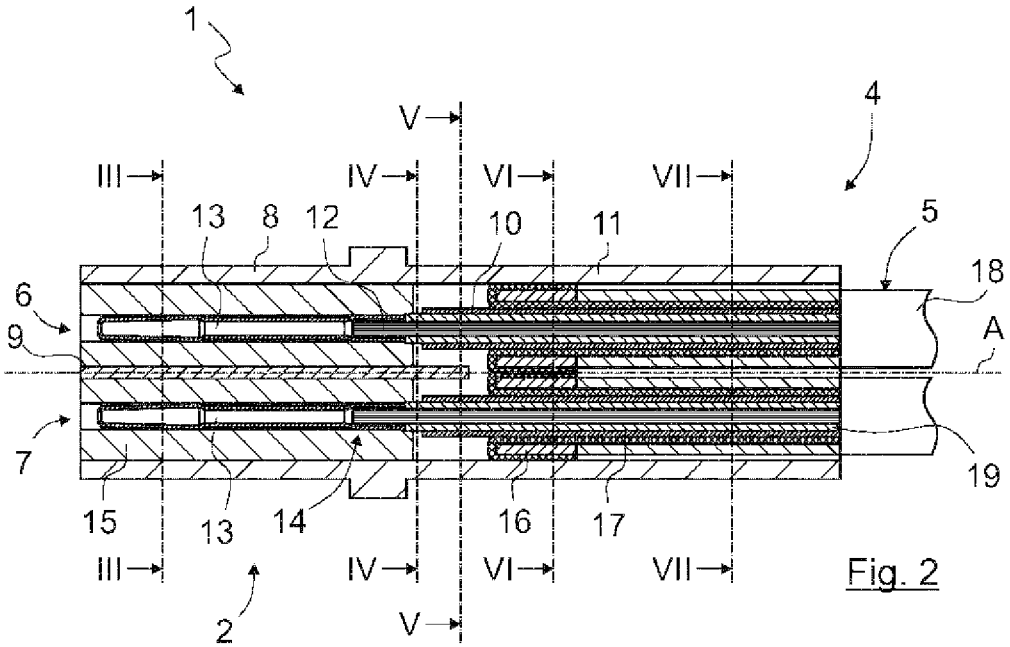
FIG. 2 is a sectional view of the distributor device of FIG. 1 taken according to the sectional plane II represented in FIG. 1.
Figure 3:
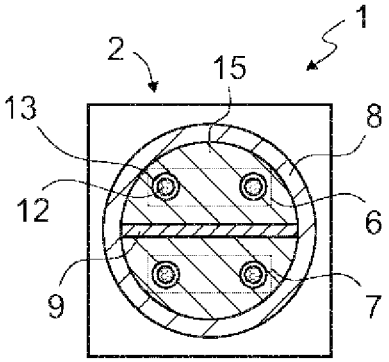
FIG. 3 is a sectional view of the distributor device of FIG. 1 taken according to the sectional plane III represented in FIG. 2.
Figure 4:
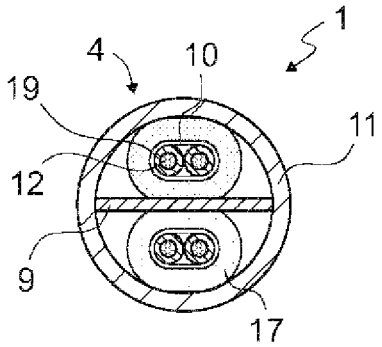
FIG. 4 is a sectional view of the distributor device of FIG. 1 taken according to the sectional plane IV represented in FIG. 2.
Figure 5:
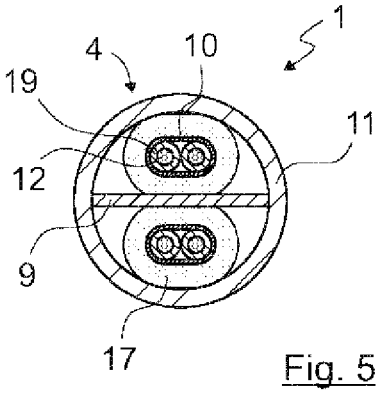
FIG. 5 is a sectional view of the distributor device of FIG. 1 taken according to the sectional plane V represented in FIG. 2.
Figure 6:
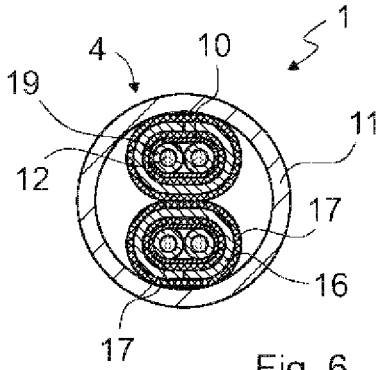
FIG. 6 is a sectional view of the distributor device of FIG. 1 taken according to the sectional plane VI represented in FIG. 2.
Figure 7:
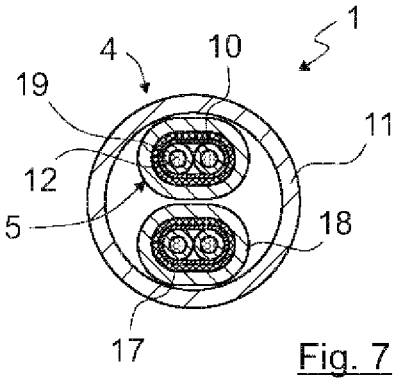
FIG. 7 is a sectional view of the distributor device of FIG. 1 taken according to the sectional plane VII represented in FIG. 2.

FIG. 2 shows a section through the electrical distributor device 1 of FIG. 1, according to the sectional plane II represented in FIG. 1. FIGS. 3 to 7, for further clarification, show in a schematic and simplified form further sectional representations according to the sectional planes III to VII represented in FIG. 2.

As can be seen in particular in FIGS. 2 to 5, the input-side connector 2 has a shielding plate 9 for electromagnetically shielding the differential contact element pairs 6, 7 from each other. In the present case, the shielding plate 9 extends into the distributor region 4 and preferably at least up to a region from which the shielding of the contact element pairs 6, 7 from each other is assumed by further means, for example a foil shield 10 of the respective electrical cables 5.

Likewise for reasons of shielding, the distributor region 4 has a metallic housing portion 11 that is realized integrally with the outer conductor part 8 of the input-side connector 2. In principle, however, the metallic housing portion 11 may also be electrically connected only to the outer conductor part 8 of the input-side connector 2, and thus be realized separately from the outer conductor part 8. In the exemplary embodiment, the transition between the input-side connector 2 and the distributor region 4 is basically fluid.

The distributor region 4 is designed to connect, preferably crimp, the contact element pairs 6, 7 of the input-side connector 2 to inner conductors 12 of a respective assigned electrical cable 5. For this purpose, the contact elements 13 of the input-side connector 2 have a corresponding crimping region 14 at their ends (in the distributor region 4) that face towards the inner conductors 12 of the cables (cf. FIGS. 2 and 11).

Provided in the input-side connector 2 for support and mutual insulation there is an insulating part 15, which accommodates the contact elements 13 within it. The shielding plate 9 in this case is accommodated in the insulating part 15.

A support sleeve 16 is provided in the distributor region 4 for each electrical cable 5 for the purpose of electrically contacting an outer conductor 17 of the respective electrical cable 5, in this case a braided cable shield. Thus, the distributor region 4 is designed to electrically connect the outer conductor part 8 of the input-side connector 2 to outer conductor parts of the output-side connectors 3 (not represented), when the outer conductor parts of the output-side connectors 3, in turn, have been connected to the outer conductors 17 of the electrical cables 5 respectively assigned to them (usually the case). An electrical connection between the outer conductor part 8 of the input-side connector 2, or the metallic housing portion 11, of the distributor region 4 may be effected by crimping the metallic housing portion 11, or the outer conductor part 8, to the underlying components.

The invention also relates to an assembly method for manufacturing an electrical distributor device 1 for high-frequency technology, which is represented by way of example, step by step and in sections, in FIGS. 8 to 13.

Figure 8:
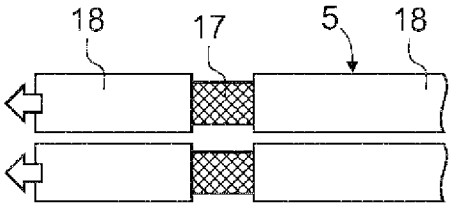
FIG. 8 is a pictorial illustration of removing the sheaths from a pair of electrical cables.

As shown in FIG. 8, in this case the cable sheaths 18 of the respective cables 5 are first stripped, or cut off, in a desired region and pulled off forwards in the direction a first end of the corresponding cable 5.

Figure 9:
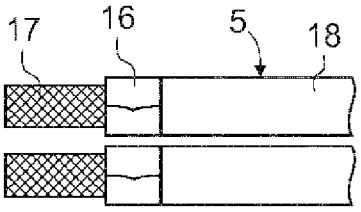
FIG. 9 is a pictorial illustration of a step of the assembly method according to the invention following the fitting of a support sleeve onto the respective cables.

As shown in FIG. 9, the support sleeve 16 is then in each case crimped onto the exposed outer conductor 17, which is preferably a braided cable shield as represented in the exemplary embodiment.

Figure 10:
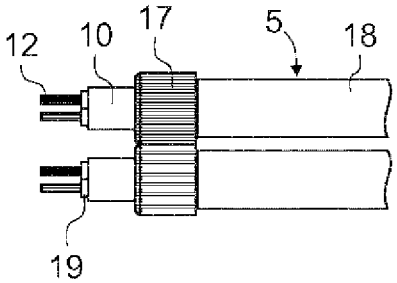
FIG. 10 is a pictorial illustration of a further step of a method according to the invention following the stripping of the front ends of the inner conductors of the cables.

As further represented in FIG. 10, the remaining braided cable shield, or the remaining outer conductor 17, may then preferably be folded back onto the supporting sleeve 16 and, if necessary, brushed straight. Alternatively, it may also be provided that the outer conductor 17, or the braided cable shield, is cut off, starting from the supporting sleeve 16. In the exemplary embodiment, beneath its outer conductor 17 the cable 5 has a foil shield 10 that encloses the inner conductors 12, or cores, of the cables 5 that are guided in a respective dielectric 19. For reasons of shielding the differential contact element pairs 6, 7 from each other, it may be advantageous to retain the foil shield 10 in at least a partial region that overlaps, for example, with a region shielded by the shield plate 9, as represented in FIG. 2. This allows tolerances to be compensated particularly well, and a continuous shielding, and thus a crosstalk between the differential contact element pairs 6, 7, can be avoided. Finally, at least in a front region of the respective cable 5, the respective inner conductors 12 may be stripped, and if necessary the dielectrics 19 enclosing the inner conductors 12 in each case may additionally be exposed so that they partially protrude under the foil shield 10, as represented in FIG. 10. The protective and insulating effect of the dielectrics 19 can thereby be maintained over as large a region as possible.

Figure 11:
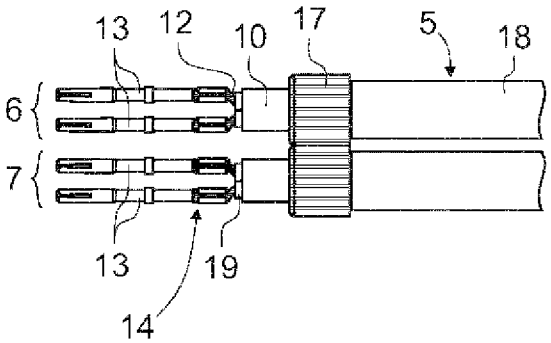
FIG. 11 is a pictorial illustration of a further step of a method according to the invention following the crimping of the inner conductors of the cables contact elements of the input-side connector.

Then, as represented in FIG. 11, each inner conductor 12 of the cables 5 may be crimped with corresponding contact elements 13 of the common input-side connector 2, while simultaneously spreading, or pitching, the contact elements 13 according to the intended interface of the input connector 2.

Figure 12:
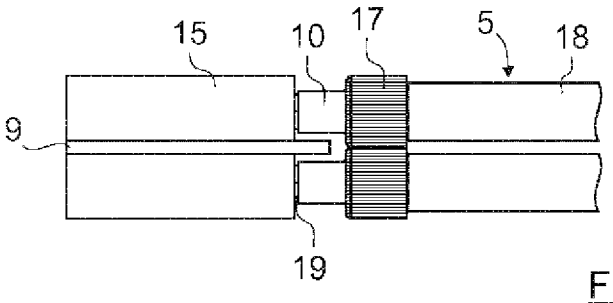
FIG. 12 is a pictorial illustration of a further step of a method according to the invention following the insertion of the contact elements into a common insulating part.

Finally, the contact elements 13 may be inserted into a common insulating part 15 of the input-side connector 2, as represented in FIG. 12. In addition in this case, at least one shielding plate 9 may be inserted, or may already be inserted, into the insulating part 15 in order to electromagnetically shield the differential contact element pairs 6, 7 of the input-side connector 2 from each other, at least starting from the region from which the foil shield 10, or the shielding by the cables 5, is no longer provided.

Figure 13:
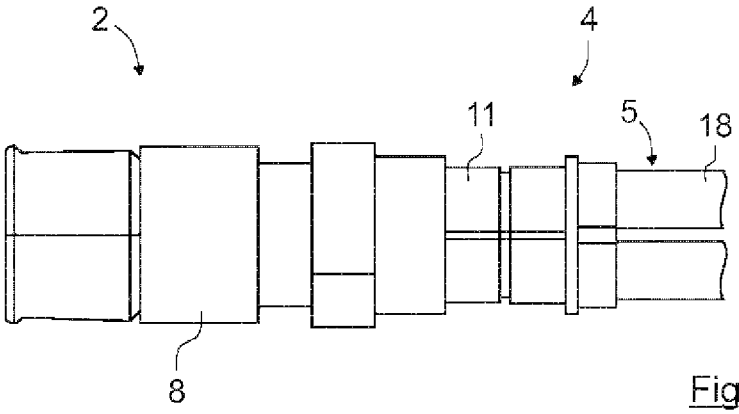
FIG. 13 is a pictorial illustration of a further step of a method according to the invention following the fitting of an outer conductor part.

Finally, there may be provided, at least in the region of the input connector 2, an outer conductor part 8 that extends at least between the contact elements 13 and the support sleeves 16 in the axial direction, i.e. along a longitudinal axis A (cf. FIG. 2) of the input connector, and electrically contacts respective outer conductors 17 of the cables 5. This is represented in FIG. 13. The outer conductor part 8 may be crimped with the support sleeves 16 and/or the cable sheaths 18, and be floating in the region of the contact elements 13, or in the region of the insulating part 15.

Then, if necessary, a plastic housing may be fitted onto the outer conductor part 8 and latched to the outer conductor part 8. If necessary, a secondary securing means may be provided to secure the plastic housing on the outer conductor part 8 and/or to fix the contact elements 13.

In a further step, the second ends of the electrical cables 5 may each be preassembled with a connector 3 on the output side. Such preassembly is known in principle, for which reason it is not discussed in greater detail here.

Figure 14:
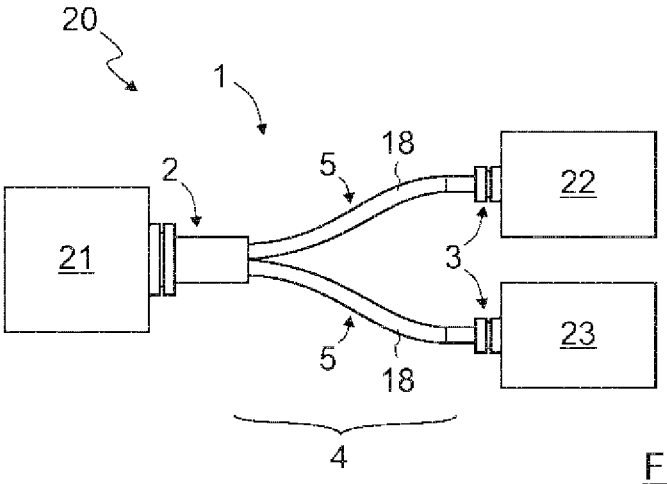
FIG. 14 is a schematic illustration of a signal transmission system according to the invention.

Finally, the invention also relates to a signal transmission system 20 for high-frequency technology, which is represented by way of example in FIG. 14. The signal transmission system 20 comprises an electrical distributor device 1 as described above, a first electrical assembly 21, a second electrical assembly 22 and at least one third electrical assembly 23, wherein at least two electrical signals are divided, via the electrical distributor device 1, from the first electrical assembly 21 between the second electrical assembly 22 and at least the third electrical assembly 23.

An advantageous use of the described electrical distributor device 1 may extend to a vehicle, in particular a motor vehicle, for transmitting and dividing high-bit-rate signals between connectors 2, 3 of different designs.

While the invention has been described with reference to various preferred embodiments, it should be understood by those skilled in the art that various changes may be made and equivalents substituted for elements thereof without departing from the scope of the invention. In addition, many modifications may be made to adapt to a particular situation or application of the invention without departing from the scope of the invention. Therefore, it is intended that the invention not be limited to the particular embodiments disclosed but rather, that the invention will include all embodiments falling within the scope of the appended claims, either literally or under the Doctrine of Equivalents.

What is claimed is:

1. An electrical distributor device for high-frequency technology, said distributor device, comprising:

an input-side connector of a first connector type;

at least two output-side connectors, the output-side connectors each being of at least one second connector type, the second connector type being a connector type which is different from the first connector type; and a distributor region arranged between the input-side connector and the output-side connectors;

wherein the input-side connector is multipolar and has at least two differential contact element pairs, and wherein the distributor region divides the contact element pairs of the input-side connector between the output-side connectors such that each of the output-side connectors has at least one respective differential contact element pair and wherein the input-side connector and each of the output-side connectors have respective outer conductor parts and wherein the distributor region electrically connects an outer conductor part of the input-side connector to outer conductor parts of the output-side connectors.

2. A distributor device as claimed in claim 1, wherein the distributor region divides the contact element pairs between two of the output-side connectors.

3. A distributor device as claimed in claim 1, wherein the contact element pairs of the input-side connector are arranged in a parallel arrangement.

4. A distributor device as claimed in claim 1, wherein the input-side connector includes at least one shielding plate for electromagnetically shielding the differential contact element pairs from one another.

5. A distributor device as claimed in claim 1, wherein the distributor region has a metallic housing portion which is electrically connected to the outer conductor part of the input-side connector.

6. A distributor device as claimed in claim 5, wherein the metallic housing portion of the distributor region is integral with the outer conductor part of the input-side connector.

7. A distributor device as claimed in claim 5, wherein the distributor region has at least one electrical cable which is fixed in the metallic housing portion and which extends to one of the output-side connectors.

8. A distributor device as claimed in claim 7, wherein each electrical cable includes inner conductors and the distributor region connects the contact element pairs of the input-side connector to the inner conductors of a respectively assigned one of the electrical cables.

9. A distributor device as claimed in claim 7, wherein each electrical cable further includes an outer conductor and the distributor region includes at least one support sleeve which electrically and mechanically contacts an outer conductor of the respectively assigned one of the electrical cables.

10. A distributor device as claimed in claim 7, wherein the distributor region connects the contact element pairs of the input-side connector to inner conductor parts of respectively assigned ones of the output-side connectors.

11. A distributor device as claimed in claim 5, wherein at least one of the output-side connectors is attached directly to the metallic housing portion of the distributor region.

12. A distributor device as claimed in claim 1, wherein the input-side connector has a high-speed data interface.

13. A distributor device as claimed in claim 1, wherein at least one of the output-side connectors has an H-MTD interface, preferably a two-pole H-MTD interface, for accommodation in a modular connector.

14. A distributor device as claimed in claim 1, wherein the distributor region includes at least one shielding plate for electromagnetically shielding the differential contact element pairs from one another.

15. A method for making a high-frequency electrical distributor device, said method comprising the steps of:

providing an input-side connector of a first connector type having at least two differential contact element pairs;

providing at least two output-side connectors, at least one of the output-side connectors being of a second connector type that is different from the first connector type;

connecting contact elements of the output-side connectors to contact elements of the input-side connector via a distributor region, the distributor region being arranged between the input-side connector and the output-side connector such that contact element pairs of the input-side connector are divided between the output-side connectors such that each of the output-side connectors has at least one respective differential contact element pair;

wherein the input-side connector and each of the output-side connectors have respective outer conductor parts and wherein the distributor region electrically connects an outer conductor part of the input-side connector to outer conductor parts of the output-side connectors.

16. A method as claimed in claim 15, wherein the output-side connectors are connected to the input-side connector via respective electrical cables.

17. A method as claimed in claim 16, wherein said connecting step comprises the steps of:

crimping a support sleeve onto an outer conductor of each of the electrical cables;

stripping front ends of individual inner conductors of the electrical cables;

electrically connecting the individual inner conductors to respective contact elements of the common input-side connector;

inserting the contact elements into a common insulating part of the input-side connector;

fitting an outer conductor part to the input-side connector, the outer conductor part extending, in an axial direction, at least between the contact elements and the support sleeves and electrically contacting the outer conductors of the electrical cables.

18. A method as claimed in claim 15, further comprising the step of:

providing the input-side connector with at least one shielding plate between the differential contact element pairs to electromagnetically shield the differential contact element pairs of the input-side connector from each other.

19. A high-frequency signal transmission system, comprising:

an electrical distributor device having an input-side connector according to a first connector type and at least two output-side connectors according to a second connector type, the second connector type being different from the first connector type, the output-side connectors including at least a first output-side connector and a second output-side connector;

a first electrical assembly to which the input-side connector is connected;

a second electrical assembly to which the which the first output-side connector is connected; and at least one third electrical assembly to which the which the second output-side connector is connected;

wherein at least two electrical signals from the first electrical assembly are divided, via the electrical distributor device, between the second electrical assembly and at least the third electrical assembly; and wherein the input-side connector is multipolar and has at least two differential contact element pairs for differential transmission of the at least two electrical signals, the at least two differential contact element pairs being divided between the first output-side and the second output-side connector by a distributor region, the distributor region being arranged between the input-side connector and the output-side connectors, such that each of the output-side connectors has at least one respective differential contact element pair;

wherein the input-side connector and each of the output-side connectors have respective outer conductor parts and wherein the distributor region electrically connects an outer conductor part of the input-side connector to outer conductor parts of the output-side connectors.

* * * * *